US012781456B2

(12) United States Patent
Luo et al.

(10) Patent No.: US 12,781,456 B2
(45) Date of Patent: Nov. 3, 2026

(54) ANNULAR ANCHOR, METHOD FOR CALCULATING ANTITORQUE BEARING STRENGTH THEREOF AND INSTALLING AND RECYCLING ASSEMBLE FOR THE ANCHOR

(71) Applicant: CHINA THREE GORGES CORPORATION, Wuhan (CN)

(72) Inventors: Lunbo Luo, Wuhan (CN); Changping Sun, Wuhan (CN); Wei Zhang, Wuhan (CN); Jianxin Liao, Wuhan (CN); Jianping Liu, Wuhan (CN); Xingzheng Zhou, Wuhan (CN); Chengyuan Zhang, Wuhan (CN); Hongqiao Peng, Wuhan (CN); Jinhe Chen, Wuhan (CN); Yuekun Wang, Wuhan (CN); Yifeng Lin, Wuhan (CN); Juan Jiang, Wuhan (CN); Lin Lin, Wuhan (CN)

(73) Assignee: CHINA THREE GORGES CORPORATION (CN)

( * ) Notice: Subject to any disclaimer, the term of this patent is extended or adjusted under 35 U.S.C. 154(b) by 577 days.

(21) Appl. No.: 18/220,115

(22) Filed: Jul. 10, 2023

(65) Prior Publication Data

US 2024/0337083 A1 Oct. 10, 2024

(30) Foreign Application Priority Data

Apr. 7, 2023 (CN) ..... 202310387597.9

(51) Int. Cl.
*E02D 5/24* (2006.01)
*E02D 7/20* (2006.01)

(52) U.S. Cl.
CPC ..... *E02D 5/24* (2013.01); *E02D 7/20* (2013.01); *E02D 2250/0053* (2013.01);
(Continued)

(58) Field of Classification Search
CPC .... E02D 2250/0053; E02D 2250/0061; E02D 2600/10; E02D 2600/40; E02D 5/24;
(Continued)

(56) References Cited

U.S. PATENT DOCUMENTS

2023/0322334 A1* 10/2023 Lee ..... B63B 21/16
114/293

FOREIGN PATENT DOCUMENTS

CN 104912070 A 9/2015
CN 205152951 U 4/2016
(Continued)

OTHER PUBLICATIONS

Jingtao Wang, Yinghui Tian, Wenlong Liu, Le Wang, Capacity envelope of plate anchors under six degree-of-freedom loads in clay, Applied Ocean Research, vol. 126, 2022, 103267, ISSN 0141-1187, https://doi.org/10.1016/j.apor.2022.103267. (Year: 2022).*
(Continued)

*Primary Examiner* — Alexander Satanovsky
*Assistant Examiner* — Joshua L Forristall

(57) ABSTRACT

The present disclosure provides an annular anchor, a method for calculating antitorque bearing strength thereof and an installing and recycling assemble for the anchor, relating to the technical field of ocean engineering. The annular anchor includes an anchor body opened at its upper and lower ends, and a connection portion arranged on the outer side wall of said anchor body for connecting with parts to be moored. The annular anchor provided by the present disclosure omits the top cover as the structure prevailing in the traditional suction anchor, avoiding the drawback of installing the traditional suction anchor on the seabed, instead the annular anchor can be installed to a certain depth below the seabed. During the descent, there is no need to take into account the
(Continued)

resistance caused by the top cover, so that the annular anchor can be installed simply and quickly.

4 Claims, 18 Drawing Sheets

(52) U.S. Cl.
CPC .. *E02D 2250/0061* (2013.01); *E02D 2600/10* (2013.01); *E02D 2600/40* (2013.01)

(58) Field of Classification Search
CPC ..... E02D 7/20; B63B 2021/203; B63B 21/16; B63B 21/20; B63B 21/22; B63B 21/26; B63B 21/48; G06F 17/10
USPC ..... 702/2

See application file for complete search history.

(56) References Cited

FOREIGN PATENT DOCUMENTS

| | | | |
|---|---|---|---|
| CN | 108425379 | A | 8/2018 |
| CN | 110172997 | A | 8/2019 |
| CN | 110172998 | A | 8/2019 |
| CN | 113338329 | A | 9/2021 |
| KR | 20160059571 | A | 5/2016 |

OTHER PUBLICATIONS

"Standard Test Method for Field Vane Shear Test in Cohesive Soil." Compass.ASTM, American Society for Testing and Materials, Aug. 16, 2017, compass.astm.org/content-access?contentCode=ASTM%7CD2573-94%7Cen-US. (Year: 2017).*

Abuhajar, Osama; El Naggar, M. Hesham; and Newson, Tim, "Review of Available Methods for Evaluation of Soil Sensitivity for Seismic Design" (2010). International Conferences on Recent Advances in Geotechnical Earthquake Engineering and Soil Dynamics. 27. (Year: 2010).*

* cited by examiner

ANNULAR ANCHOR, METHOD FOR CALCULATING ANTITORQUE BEARING STRENGTH THEREOF AND INSTALLING AND RECYCLING ASSEMBLE FOR THE ANCHOR

CROSS-REFERENCE TO RELATED APPLICATION

This application claims priority from the Chinese patent application 2023103875979 filed Apr. 7, 2023, the content of which is incorporated herein in the entirety by reference.

TECHNICAL FIELD

The present disclosure relates to the technical field of ocean engineering, in particular to an annular anchor, a method for calculating antitorque bearing strength thereof and an installing and recycling assemble for the anchor.

BACKGROUND

With the gradual development of offshore wind farms and offshore oil exploitation fields toward deep sea, floating anchoring foundations in various forms have been widely applied and spread, mainly including a drag flatten anchor, a suction anchor and a dynamic anchor. Among them, the suction anchor is widely used due to its convenient construction, high cost performance, recyclability and other advantages.

The suction anchor typically has a cylindrical body closed at its upper end and opened at its lower end, and a drainage outlet arranged on its top plate to connect to pumping equipment. In the process of penetration, the suction anchor firstly sinks into the seabed in a certain depth to form a closed environment under the action of its own weight, then enables a pressure difference to form between the inside and outside of the anchor body by using a pump at its top portion to draw water, next continues to sink under the action of the pressure difference between its inside and outside until the upper end of the suction anchor reaches the seabed surface. The suction anchor fixed to the seabed is subject to erosion, and the foundation shallowly embedded close to the seabed provides relatively low bearing strength.

Due to its own structural properties, the suction anchor can only easily reach the seabed surface during the descent. Providing the suction anchor is hoped to further sink, in the case that its upper end is closed, its anchor body is filled with soil, so that the suction anchor is subject to great resistance, and it is more difficult to enable the suction anchor to further sink.

SUMMARY

Therefore, the technical problem to be solved by the present disclosure, providing an annular anchor, a method for calculating antitorque bearing strength thereof and an installing and recycling assemble for the anchor, is to overcome the defect of the prior art that: the suction anchor is subject to great resistance when it reaches the seabed surface and then continues to sink, enabling the suction anchor to more difficultly continue to further sink into the seabed.

In order to solve the above technical problem, the present disclosure provides an annular anchor, comprising an anchor body opened at its upper and lower ends, and a connection portion arranged on the outer side wall of the anchor body for connecting with parts to be moored.

Optionally, at least one group of wing plates is arranged on the outer side wall of the anchor body, and the multiple groups of wing plates are spaced along the circumference of the anchor body.

Optionally, the number of the wing plates is not more than five groups.

Optionally, the wing plate is designed to be a rectangular structure, a triangular structure or an arc-shaped structure.

Optionally, the connection portions are configured to be in at least one group, the connection portions are spaced along the circumference of the anchor body.

The present disclosure provides a method for calculating antitorque bearing strength of the annular anchor, comprising a step of calculating antitorque bearing strength of the anchor body of the annular anchor, its calculation formula is as follows:

$$T_0 = \frac{\alpha s_u \pi D^2 L}{2}$$

where, $\alpha$ is a partial remodeling factor of soil strength, $\alpha=1$ for an entire soil, and $\alpha=1/S_t$ for a completely-remolded soil, $S_t$ is sensitivity of soil;

$S_u$ is shearing strength of soil without drainage;

L is the height of the annular anchor;

D is the outer diameter of the annular anchor.

Optionally, the method further includes a step of calculating the antitorque bearing strength of a single wing plate, based on the following formula:

$$\Delta T_{N=1} = \delta_{N=1} \int N_{p,N=1} s_u s \frac{s+D}{2} dz$$

where, S is the width of the wing plate; $\delta_{N=1}$ is a scale factor, which is calculated as follows;

$$\delta_{N-1} = 0.166 \log \frac{s}{D} + 1$$

$N_{p,N=1}$ is calculated as follows;

$$N_{p,N=1} = 2N_{p0,N=1}$$

$$N_{p0,N=1} = 11.94 - 8.72\left[1 - \left(\frac{L}{H(s+0.5)}\right)^{0.6}\right]^{1.35}$$

$$H = 16.8 - 2.3\log\left(\frac{s_{um}}{kD}\right)$$

where, $S_{um}$ is shearing strength of soil without drainage on the mud surface of a seabed;

k is a gradient of soil strength;

H is a gradient of normalized soil strength;

$N_{p,N=1}$ is a coefficient of horizontal bearing strength of the single wing plate when the plate and the soil are inseparable;

$N_{p0,N=1}$ is a coefficient of horizontal bearing strength of the single wing plate when the plate and the soil are separable.

Optionally, the method further includes a step of calculating the antitorque bearing strength of multiple single wing plates, based on the following formula:

$$\Delta T_N = \zeta_N \Delta T_{N=1}$$

where, $\Delta T_N$ is the antitorque bearing strength of all single wing plates; $\zeta_N$ is a wing plate's effect coefficient, its formula is as follows;

$$\zeta_N = \sum_{i=1}^{i=N} 0.5^{\left(\frac{i-1}{1.15}\right)^{2.3}}.$$

Optionally, the method further includes a step of calculating the antitorque bearing strength of an entire annular anchor, based on the following formula:

$$T_N = T_0 + \Delta T_N$$

where, $T_N$ is the antitorque bearing strength of the entire annular anchor.

The present disclosure provides an annular anchor installing assembly, comprising the annular anchor as any one of described above, and and an installation tube, one end of which is provided with an installation cover body, and the other end of which is configured to be an open end used to cooperate with the top of the annular anchor; wherein a first installation lifting point used to connect with a hoist, an installation pump body assembly used to vacuum the interior of the installation tube, and a second installation lifting point used to connect with an anchor chain on the annular anchor are arranged on the installation cover body, and the second installation lifting point is removably connected to the installation cover body;

the height dimension of the installation tube is greater than the distance between the seabed and the top of the annular anchor during the latter's functioning.

Optionally, the bottom end of the installation tube is provided with an installation guiding piece extending downwards from the inner wall and suitable for protruding into the interior of the annular anchor.

The present disclosure provides an annular anchor recycling assembly, comprising the annular anchor as any one of described above, and a recycling tube, one end of which is provided with a recycling cover body, and the other end of which is configured to be an open end used to cooperate with the top of the annular anchor; wherein a first recycling lifting point used to connect with a hoist, a recycling pump body assembly used to perform a pressure boost in the interior of the recycling tube, and a second recycling lifting point used to connect with an anchor chain on the annular anchor are arranged on the recycling cover body;

the height dimension of the recycling tube is greater than the distance between the seabed and the top of the annular anchor during the latter's functioning.

Optionally, the bottom end of the recycling tube is provided with a recycling guiding piece extending downwards from the inner wall and suitable for protruding into the interior of the annular anchor, and the bottom end of the recycling guiding piece is provided with a guiding portion bent toward its center.

The technical solution of the present disclosure has the following advantages:

1. The annular anchor provided by the present disclosure has an anchor body opened at its upper and lower ends with omittance of the top cover as the structure prevailing in the traditional suction anchor, avoiding the drawback of installing the traditional suction anchor on the seabed, instead the annular anchor can be installed to a certain depth below the seabed. During the descent, there is no need to take into account the resistance caused by the top cover, so that the annular anchor can be installed simply and quickly, and there is no need to take into account the anti-erosion of the annular anchor installed at a certain depth below the seabed during its functioning, furthermore, the annular anchor improves its torsion resistance benefitting from the bearing performance of the deeper soil body.
2. In the annular anchor provided by the present disclosure, at least one group of wing plates is arranged on the outer wall of the anchor body, and the wing plates are spaced along the circumference of the anchor body. The addition of the wing plates enables the torsion resistance of the annular anchor to further improve, and the annular anchor to get a full boost to effectively twist and shear the anchored area in the deep soil body, significantly enhancing the antitorque bearing performance of the suction anchor, meanwhile saving consumables, and raising cost performance.
3. The method for calculating antitorque bearing strength of the annular anchor provided by the present disclosure, optimizes the structural design of the annular anchor by calculating the antitorque bearing strength of the anchor body, the wing plates and their entirety, and makes use of the antitorque bearing strength of the annular anchor to a maximum extent.
4. The annular anchor installing assembly provided by the present disclosure includes an annular anchor and an installation tube cooperated with the annular anchor. The installation pump body assembly during pumping and filling water enables the annular anchor to be installed and the installation tube to be recycled, so as to fast, simply and conveniently install the annular anchor to a designed depth below the seabed, and possibly reuse the installation tube, reducing costs.
5. In the annular anchor installing assembly provided by the present disclosure, the bottom end of the installation tube has an installation guiding piece extending downwards from the inner wall, and the installation guiding piece is configured to facilitate the rapid fit between the installation tube and the annular anchor and impose a radial restraint on the annular anchor, avoiding misalignment caused by instability between the annular anchor and the installation tube during installation, from affecting the installation.
6. The annular anchor recycling assembly provided by the present disclosure includes an annular anchor and a recycling tube cooperated with the annular anchor. The recycling pump body assembly during filling water enables the annular anchor and the recycling tube to cooperate with a hoist, so as to hoist them to fast, simply, conveniently and less noisily complete recycling without a too big pulling force, and possibly reuse the recycling tube, reducing costs.

7. In the annular anchor recycling assembly provided by the present disclosure, the bottom end of the recycling tube has a recycling guiding piece extending downwards from the inner wall, and the recycling guiding piece is configured to facilitate the rapid fit between the recycling tube and the annular anchor and impose a radial restraint on the annular anchor, avoiding misalignment caused by instability between the annular anchor and the recycling tube during installation, from affecting the recycling. Furthermore, the bottom end of the recycling guiding piece has a guiding portion bent toward its center, which is configured to lock the annular anchor in advance, avoiding the annular anchor from tilting and resultant difficult butting junction.

BRIEF DESCRIPTION OF THE DRAWINGS

To describe the embodiments of the present disclosure or the technical solutions in the prior art more clearly, the following briefly introduces the accompanying drawings required for describing the embodiments or the descriptions in the prior art. Apparently, the accompanying drawings in the following description show merely some embodiments of the present disclosure, and a person of ordinary skill in the art may still derive other drawings from these accompanying drawings without creative efforts.

Wherein, 1—anchor body; 2—connection portion; 3—wing plate; 4—connection rod; 5—anchor chain; 6—installation tube; 7—installation cover body; 8—first installation lifting point; 9—installation pump body assembly; 10—second installation lifting point; 11—installation guiding piece; 12—recycling tube; 13—recycling cover body; 14—first recycling lifting point; 15—recycling pump body assembly; 16—second recycling lifting point; 17—recycling guiding piece; 18—guiding portion; 19—high-frequency vibratory hammer.

DETAILED DESCRIPTION OF SOME EMBODIMENTS

The technical solutions in the embodiments of the present disclosure will be clearly and completely described as follows in combination with the drawings in the examples of the present disclosure, but obviously, the described examples are only a part of the embodiments of the present disclosure, rather than all the embodiments. Based on the examples of the present disclosure, all other examples obtained by a person skilled in the art without creative efforts shall fall within the protection scope of the present disclosure.

Furthermore, the technical features involved in different embodiments of the present disclosure described as follows can be combined with each other as long as they do not conflict with each other.

Example 1

A annular anchor provided by the present embodiment can server as a fixed part of a vessel mooring system, also as a foundation structure for offshore platforms, large docks and suchlike.

Figure 1:
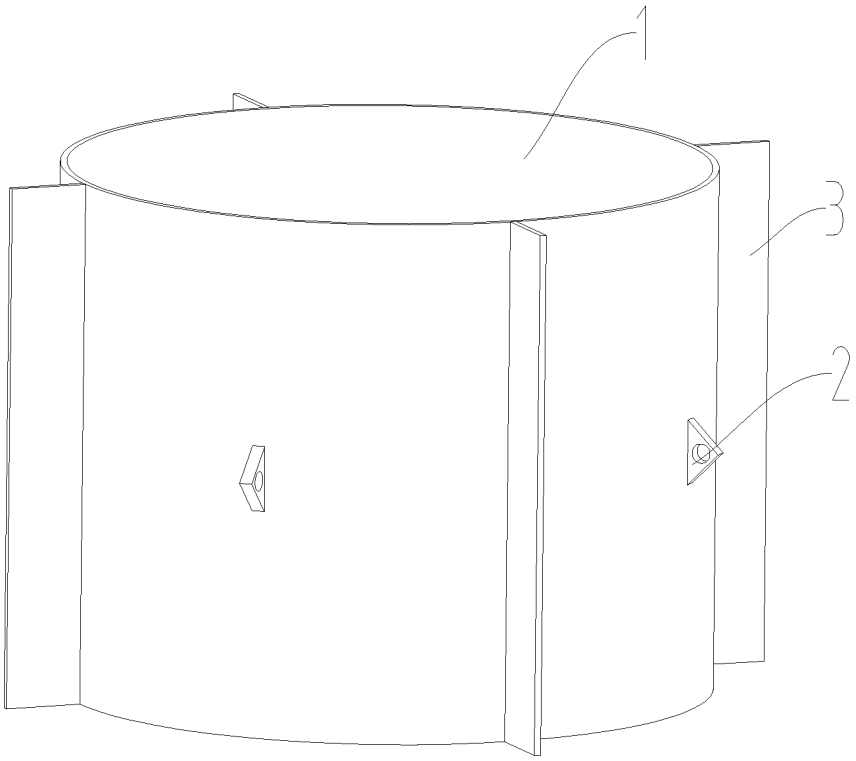
FIG. 1 is a structural schematic view of one specific embodiment of the annular anchor provided in the first example of the present disclosure.
Figure 2:
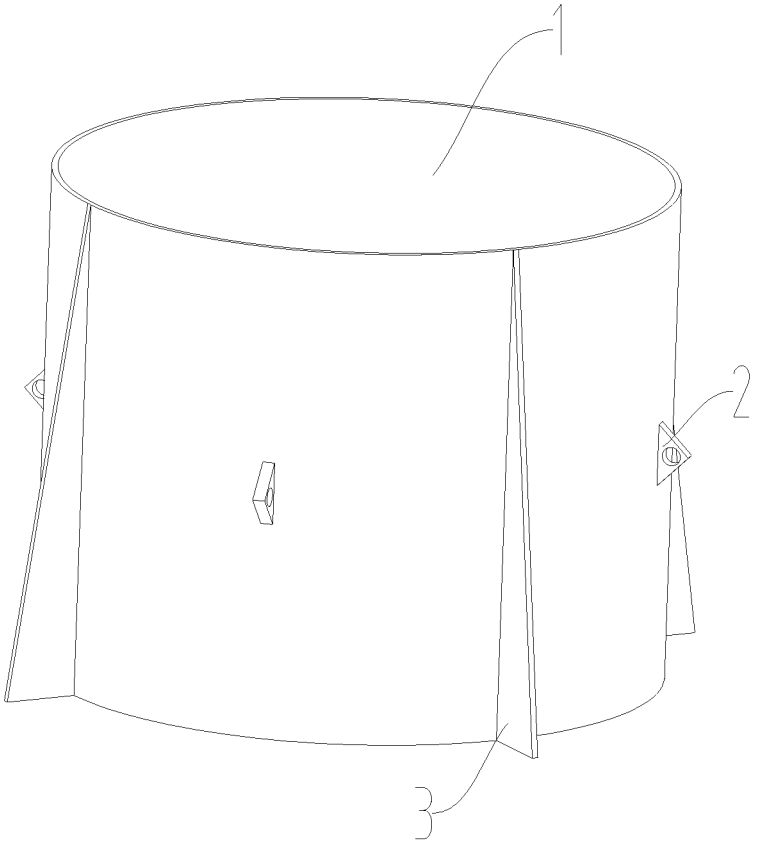
FIG. 2 is a structural schematic view of another specific embodiment in FIG. 1.
Figure 3:
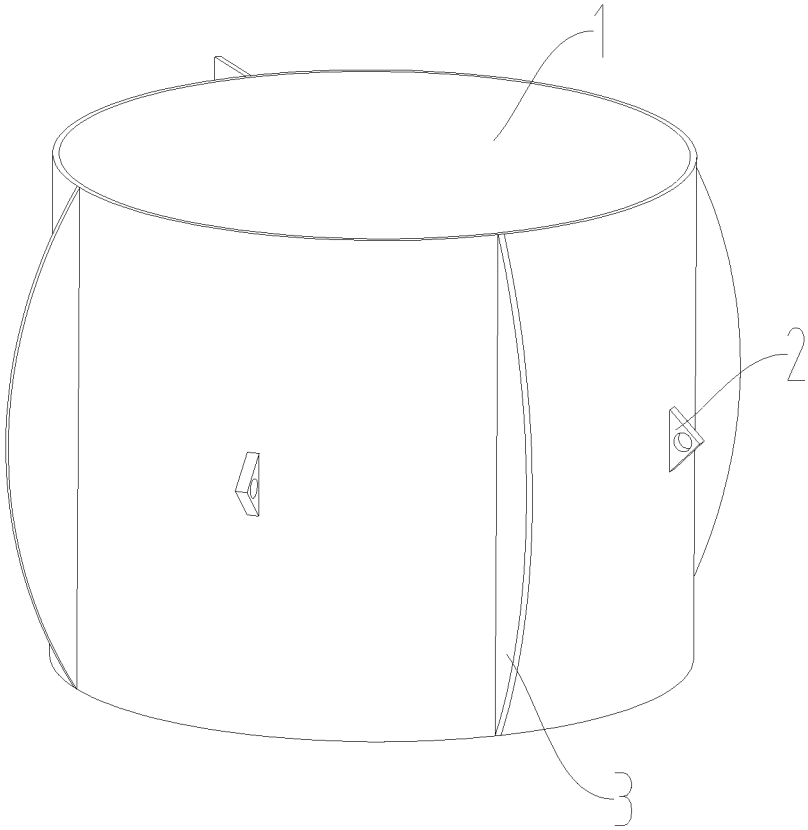
FIG. 3 is a structural schematic view of the third specific embodiment in FIG. 1.

As shown in FIGS. 1-3, one specific embodiment of the annular anchor provided by this example includes the anchor body 1 and the connection portion 2, the anchor body 1 is opened at its upper and lower ends, the connection portion 2 is arranged on the outer side wall of the anchor body 1 for connecting with parts to be moored. Specifically, the connection portion 2 is configured to be a lifting lug structure for connecting an anchor chain, the connection portion 2 can be arranged at the one-third position below the anchor body 1, and the parts to be moored may be a vessel, a wind farm, a platform and suchlike.

The anchor body 1 is opened at its upper and lower ends with omittance of the top cover as the structure prevailing in the traditional suction anchor, avoiding the drawback of installing the traditional suction anchor on the seabed, instead the annular anchor can be installed to a certain depth below the seabed. During the descent, there is no need to take into account the resistance caused by the top cover, so that the annular anchor can be installed simply and quickly, and there is no need to take into account the anti-erosion of the annular anchor installed at a certain depth below the seabed during its functioning, furthermore, the annular anchor improves its torsion resistance benefitting from the bearing performance of the deeper soil body.

As shown in FIGS. 1-3, in the annular anchor provided by this example, at least one group of wing plates 3 is arranged on the outer side wall of the anchor body 1, multiple groups of wing plates 3 are spaced along the circumference of the anchor body, and the interspace between the wing plates 3 are configured in the light of corresponding offshore wind conditions. The addition of the wing plates 3 enables the torsion resistance of the annular anchor to further improve, and the annular anchor to get a full boost to effectively twist and shear the anchored area in the deep soil body, significantly enhancing the antitorque bearing performance of the suction anchor, meanwhile saving consumables, and raising cost performance.

Specifically, the number of wing plates 3 in the annular anchor is not more than five groups, although the antitorque bearing performance of the annular anchor can be enhanced by increasing the number of wing plates 3, the number of wing plates 3 should not be too much, not more than five groups, so as to control installation costs and maximize a boost in bearing performance of the wing plates 3.

Specifically, the wing plate 3 is designed to be a rectangular structure, a triangular structure or an arc-shaped structure, and the wing plates in various structures, which may be can be selected according to different force conditions, can enhance the antitorque bearing performance of the annular anchor.

Specifically, the connection portions 2 are configured to be in at least one group, the connection portions 2 are spaced along the circumference of the anchor body 1. A group of annular anchors benefited for its own high torsion resistance can anchor multiple groups of parts to be moored at the same time, realizing sharing the annular anchor, which can be used as a shared annular anchor for multiple groups of parts to be moored to form a continuous anchor foundation, reducing the number of the used annular anchors with high availability and good economy, and achieving reducing costs and enhancing efficiency.

Figure 4:
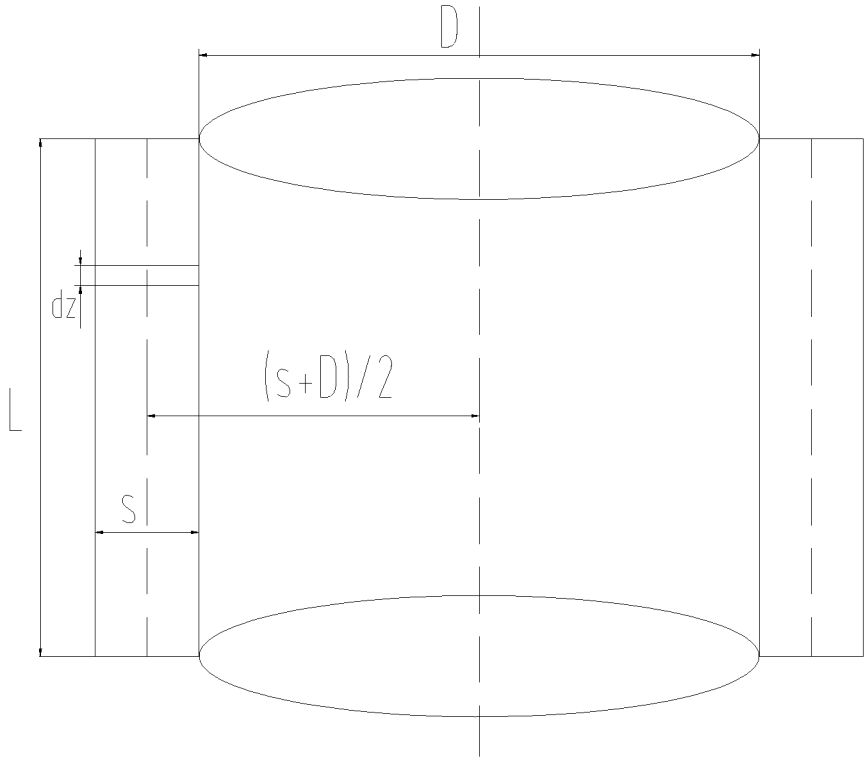
FIG. 4 is a schematic view of the dimensioning for the calculation method of the annular anchor in FIG. 1.

As shown in FIG. 4, the annular anchor has the rectangular wing plates 3, and its antitorque bearing strength can be calculated by adopting the following method. A rectangular wing plate is taken as a example, which will be adjusted to calculate according to the area in the case of other structures, the method includes the following steps.

1. Calculating the Antitorque Bearing Strength of an Annular Anchor Without a Wing Plate.

For the annular anchor without a wing plate, the antitorque bearing strength is provided by the friction between the anchor body 1 of the annular anchor and the soil body, and its calculation formula is as follows:

$$T_0 = \frac{\alpha s_u \pi D^2 L}{2}$$

Where, $\alpha$ is a partial remodeling factor of soil strength, $\alpha=1$ for an entire soil, and $\alpha=1/S_t$ for a completely-remolded soil, $S_t$ is sensitivity of soil; $S_u$ is the shearing strength of the soil without drainage; L is the height of the annular anchor; D is the outer diameter of the annular anchor.

2. Calculating the Antitorque Bearing Strength of a Single Wing Plate.

Under the action of a torque load, the failure mode of the single wing plate 3 can be equivalent to the failure caused by a horizontal load in a small strain range. Its bearing strength can be calculated according to the following formula.

$$\Delta T_{N=1} = \delta_{N=1} \int N_{p,N=1} s_u s \frac{s+D}{2} dz$$

Where, S is the width of the wing plate; $\delta_{N=1}$ is a scale factor, which is calculated as follows.

$$\delta_{N=1} = 0.166 \log \frac{s}{D} + 1$$

$N_{p,N=1}$ is calculated as follows.

$$N_{p,N=1} = 2N_{p0,N=1}$$

$$N_{p0,N=1} = 11.94 - 8.72\left[1 - \left(\frac{L}{H(s+0.5)}\right)^{0.6}\right]^{1.35}$$

$$H = 16.8 - 2.3\log\left(\frac{s_{um}}{kD}\right)$$

Where, $S_{um}$ is the shearing strength of the soil without drainage on the mud surface of the seabed; k is a gradient of soil strength; H is a gradient of normalized soil strength; $N_{p,N=1}$ is the coefficient of the horizontal bearing strength of the single wing plate when the plate and the soil are inseparable; $N_{p0,N=1}$ is the coefficient of the horizontal bearing strength of the single wing plate when the plate and the soil are separable.

3. Calculating the Antitorque Bearing Strength of Multiple Single Wing Plates.

The antitorque bearing strength of the single wing plate 3 cannot be directly accumulated to give the antitorque bearing strength provided by multiple single wing plates 3 to the annular anchor. In fact, with the increase of the number of the wing plates 3, the antitorque bearing strength excited by each wing plate 3 will not increase after reaching a certain peak, then the wing plate's effect coefficient reaches a maximum. The antitorque bearing strength of multiple single wing plates 3 can be calculated as follows.

$$\Delta T_N = \zeta_N \Delta T_{N=1}$$

Where, $\Delta T_N$ is the antitorque bearing strength of all single wing plates; $\zeta_N$ is a wing plate's effect coefficient, its formula is as follows.

$$\zeta_N = \sum_{i=1}^{i=N} 0.5^{\left(\frac{i-1}{1.15}\right)^{2.3}}$$

4. Calculating the Antitorque Bearing Strength of an Entire Annular Anchor.

The antitorque bearing strength of the annular anchor added with wing plates is the sum of the antitorque bearing strength $T_0$ provided by the anchor body 1 and the antitorque bearing strength $\Delta T_N$ provided by the wing plates 3, that is, $$T_N = T_0 + \Delta T_N$$

Where, $T_N$ is the antitorque bearing strength of the entire annular anchor.

Based on the aforementioned method for calculating antitorque bearing strength, the optimal size of the annular anchor can be selected.

Example 2

Figure 5:
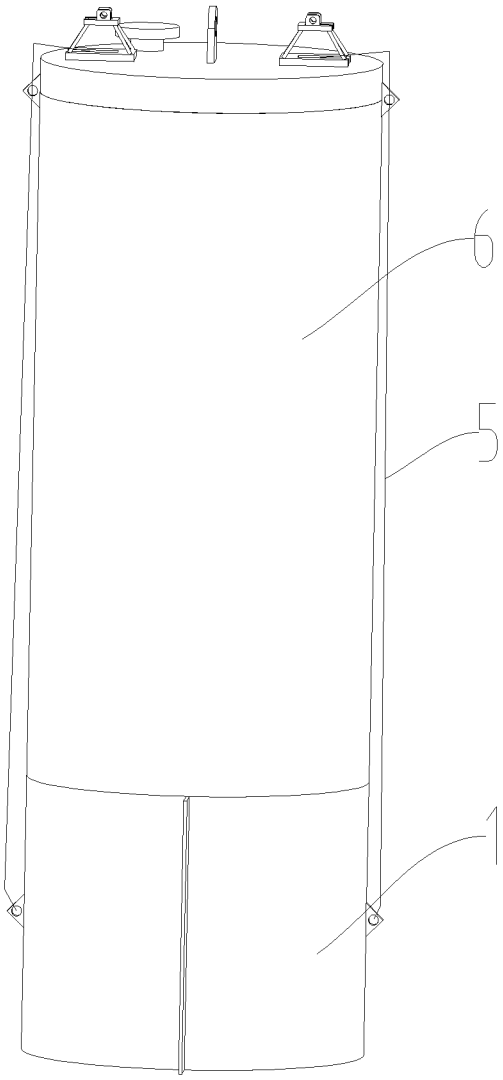
FIG. 5 is a structural schematic view of one specific embodiment of the annular anchor installing assembly provided in the second example of the present disclosure.
Figure 6:
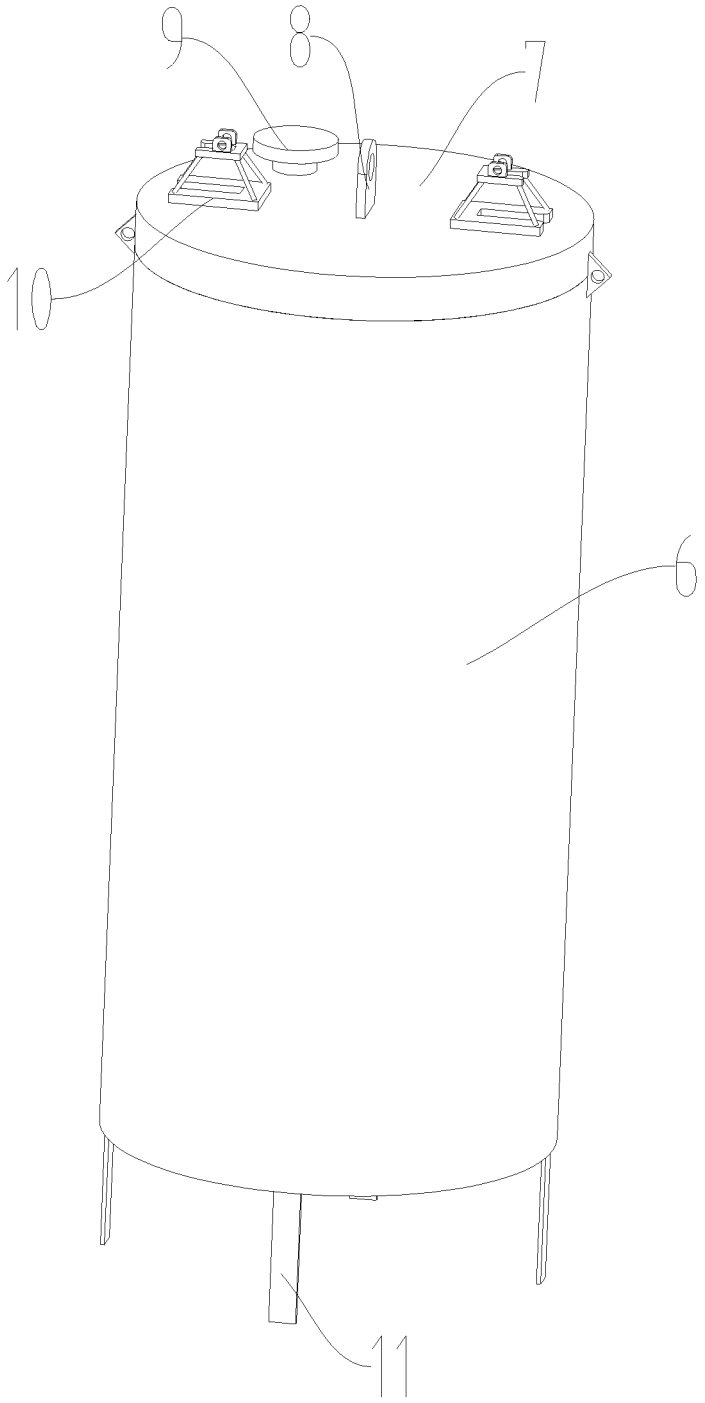
FIG. 6 is a structural schematic diagram of the installation tube in FIG. 5.
Figure 7:
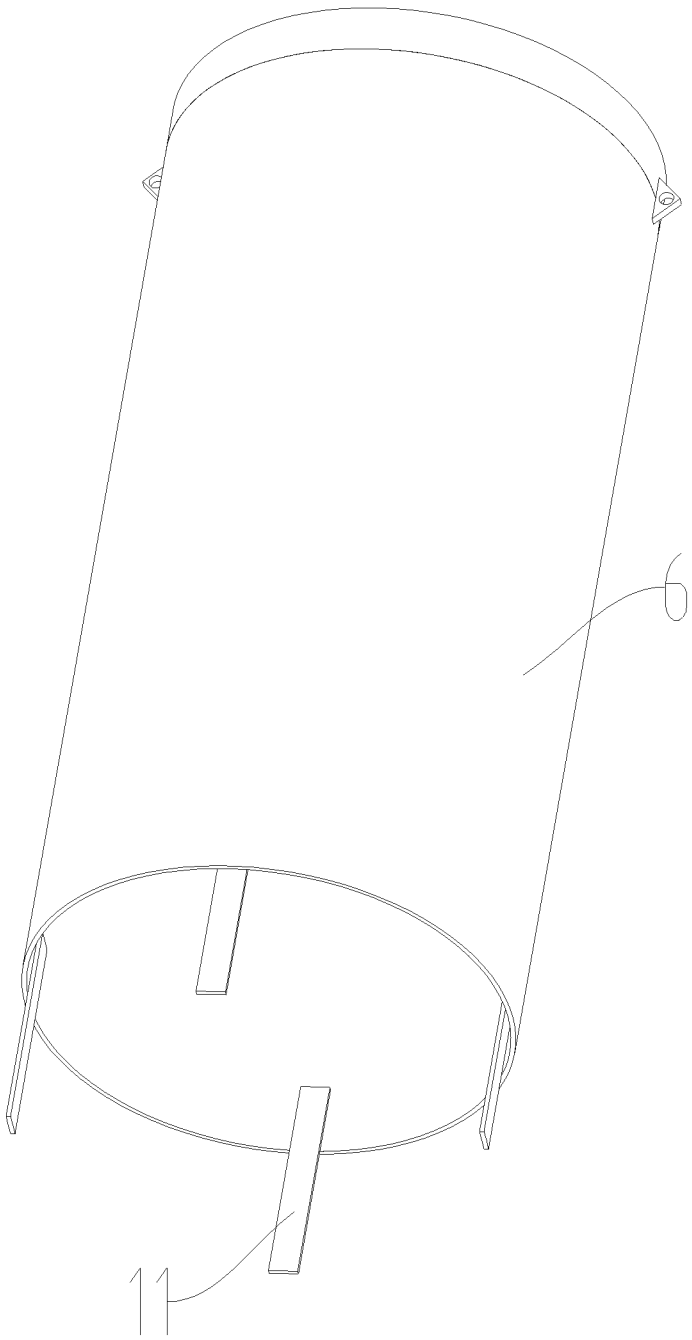
FIG. 7 is a structural schematic diagram of the bottom of the installation tube in FIG. 6.

As shown in FIGS. 5-7, the specific embodiment of the annular anchor installing assembly provided by this example includes the annular anchor as described in Example 1, and the installation tube 6, one end of which is provided with the installation cover body 7, and the other end of which is configured to be an open end used to cooperate with the top of the annular anchor; the first installation lifting point 8 used to connect with a hoist, the installation pump body assembly 9 used to vacuum the interior of the installation tube 6, and the second installation lifting point 10 used to connect with the anchor chain 5 on the annular anchor are arranged on the installation cover body 7, and the second installation lifting point 10 is removably connected to the installation cover body 7.

The installation pump body assembly 9 during pumping and filling water enables the annular anchor to be installed and the installation tube 6 to be recycled, so as to fast, simply and conveniently install the annular anchor to a designed depth below the seabed, and possibly reuse the installation tube, reducing costs.

The height dimension of the installation tube 6 is greater than the distance between the seabed and the top of the annular anchor during the latter's functioning, avoiding the installation tube 6 from being jammed with too high soil in the process of negative pressure penetration, and the soil from being sucked into the installation pump body assembly 9 to damage the equipment resultantly. Specifically, the first installation lifting point 8 and the second installation lifting point 10 are provided as a lifting lug structure, the annular anchor is coaxially fixed to the open end of the installation tube 6 by the anchor chain 5, and the end face of the open end of the installation tube 6 is butted to the end face of the annular anchor.

As shown in FIGS. 6-7, in the annular anchor installing assembly provided by Example 3, the bottom end of the installation tube 6 is provided with the installation guiding piece 11 extending downwards from the inner wall and suitable for protruding into the interior of the annular anchor. The installation guiding piece 11 is configured to facilitate the rapid fit between the installation tube 6 and the annular anchor and impose a radial restraint on the annular anchor, avoiding misalignment caused by instability between the annular anchor and the installation tube 6 during installation, from affecting the installation. Specifically, the installation guiding piece 11 may be configured to be a rectangular structure, or a curved plate structure adapted to the inner wall of the annular anchor. In addition, as an alternative embodiment, the installation guiding piece 11 may also be clamped to the outer wall of the annular anchor, extending downwards from the outer wall of the bottom end of the installation tube 6.

Example 3

Figure 8:
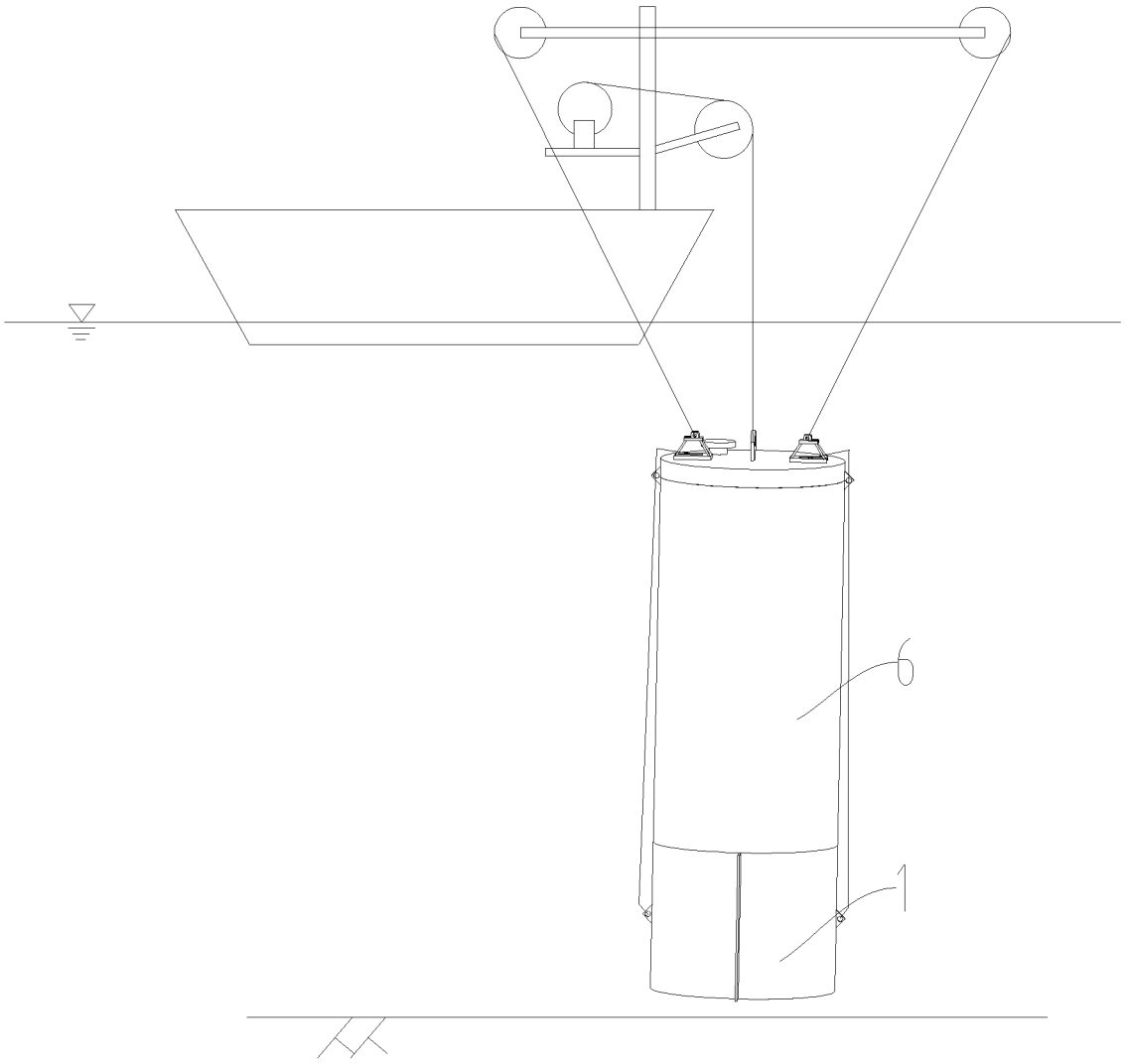
FIG. 8 is a structural schematic view of one specific embodiment of the annular anchor installing method provided in the third example of the present disclosure.
Figure 9:
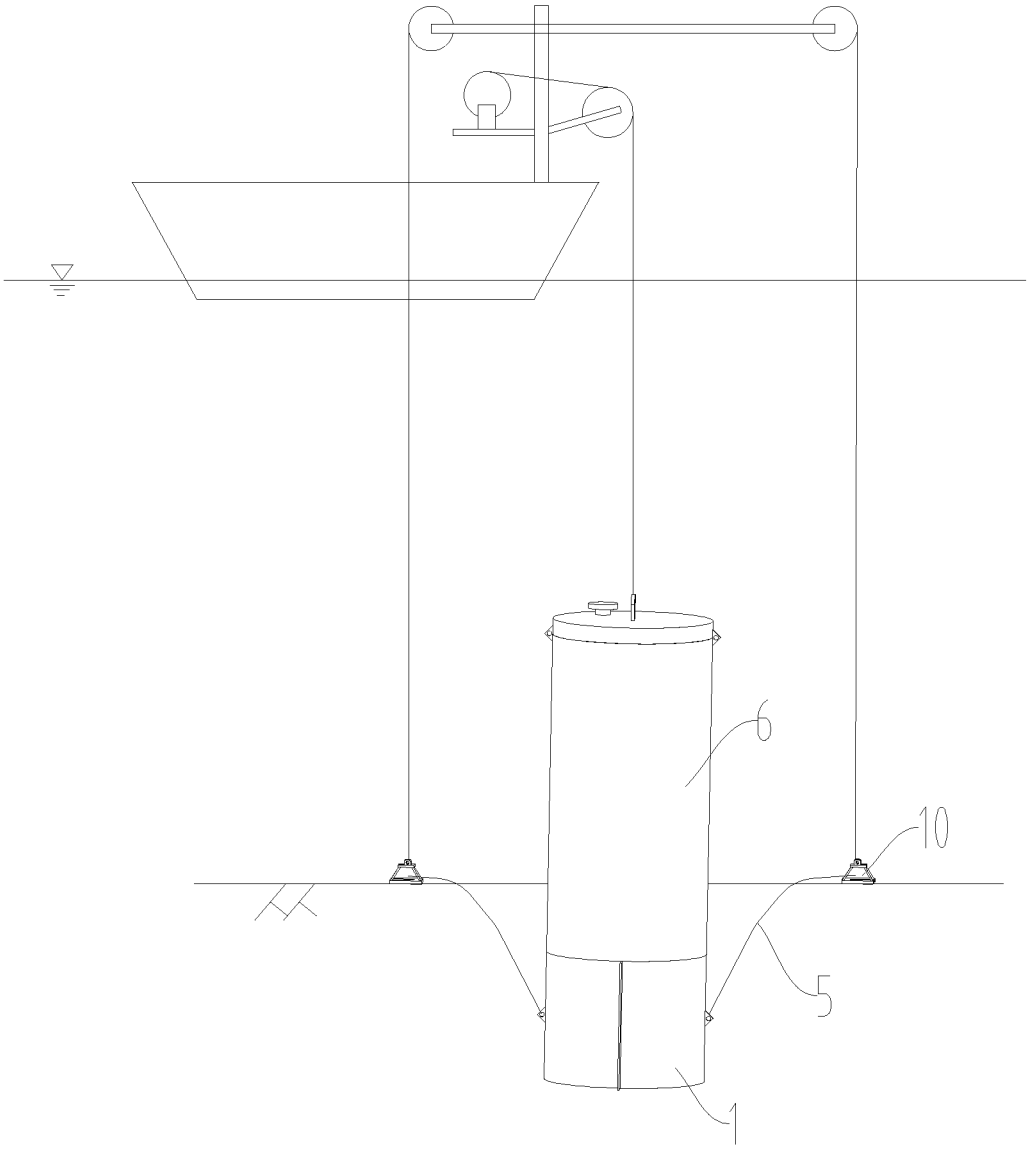
FIG. 9 is a structural schematic view of sinking the annular anchor to a designed depth below the seabed in FIG. 8
Figure 10:
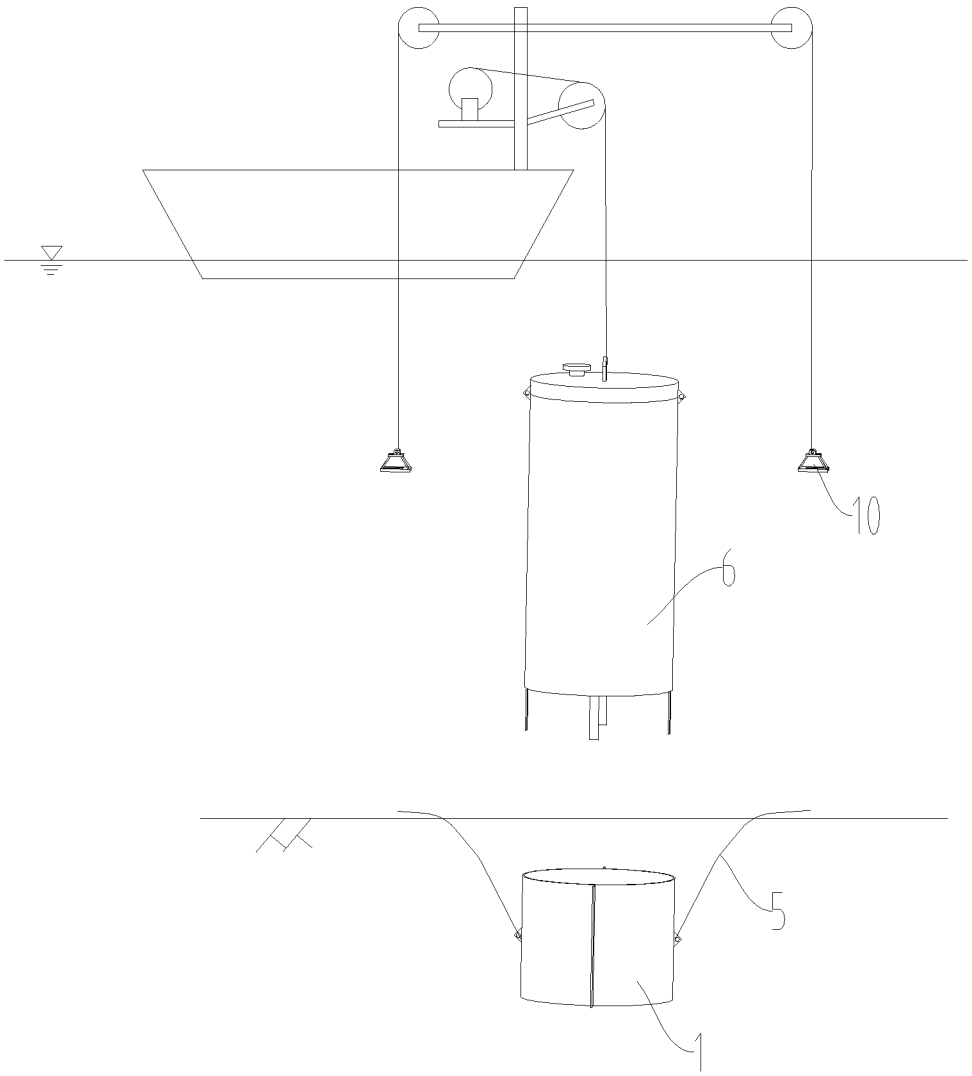
FIG. 10 is a structural schematic view of recycling the installation tube in FIG. 9.
Figure 11:
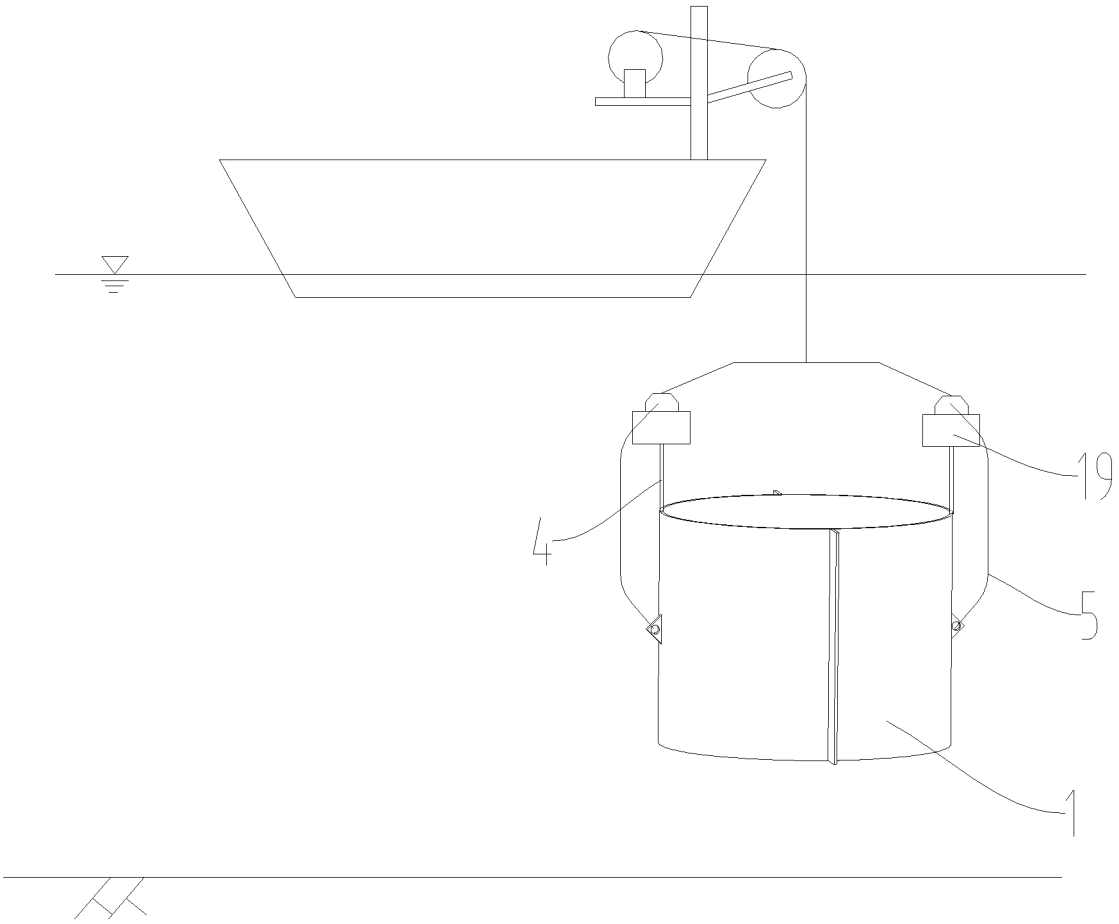
FIG. 11 is a structural schematic view of one specific embodiment of the annular anchor installing method provided in the fourth example of the present disclosure.
Figure 12:
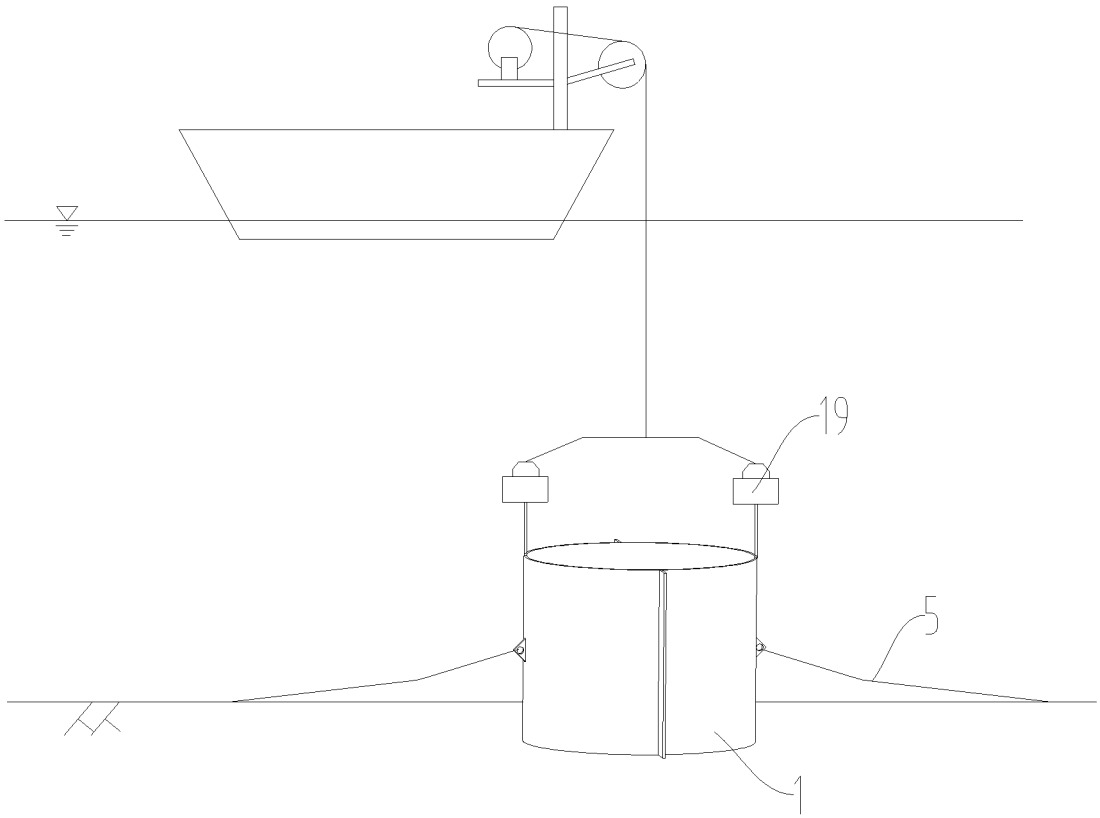
FIG. 12 is a structural schematic view of the anchor chain being disassembled in FIG. 11.
Figure 13:
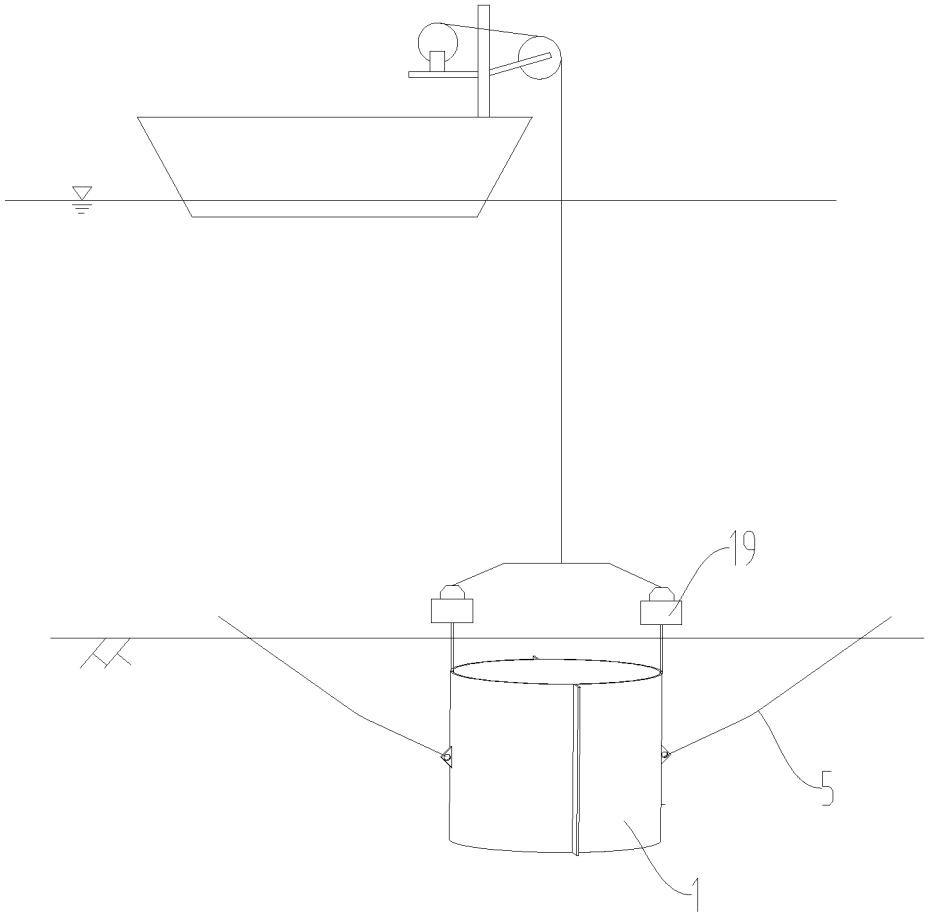
FIG. 13 is a structural schematic view of the annular anchor reaching the designed position in FIG. 11.
Figure 14:
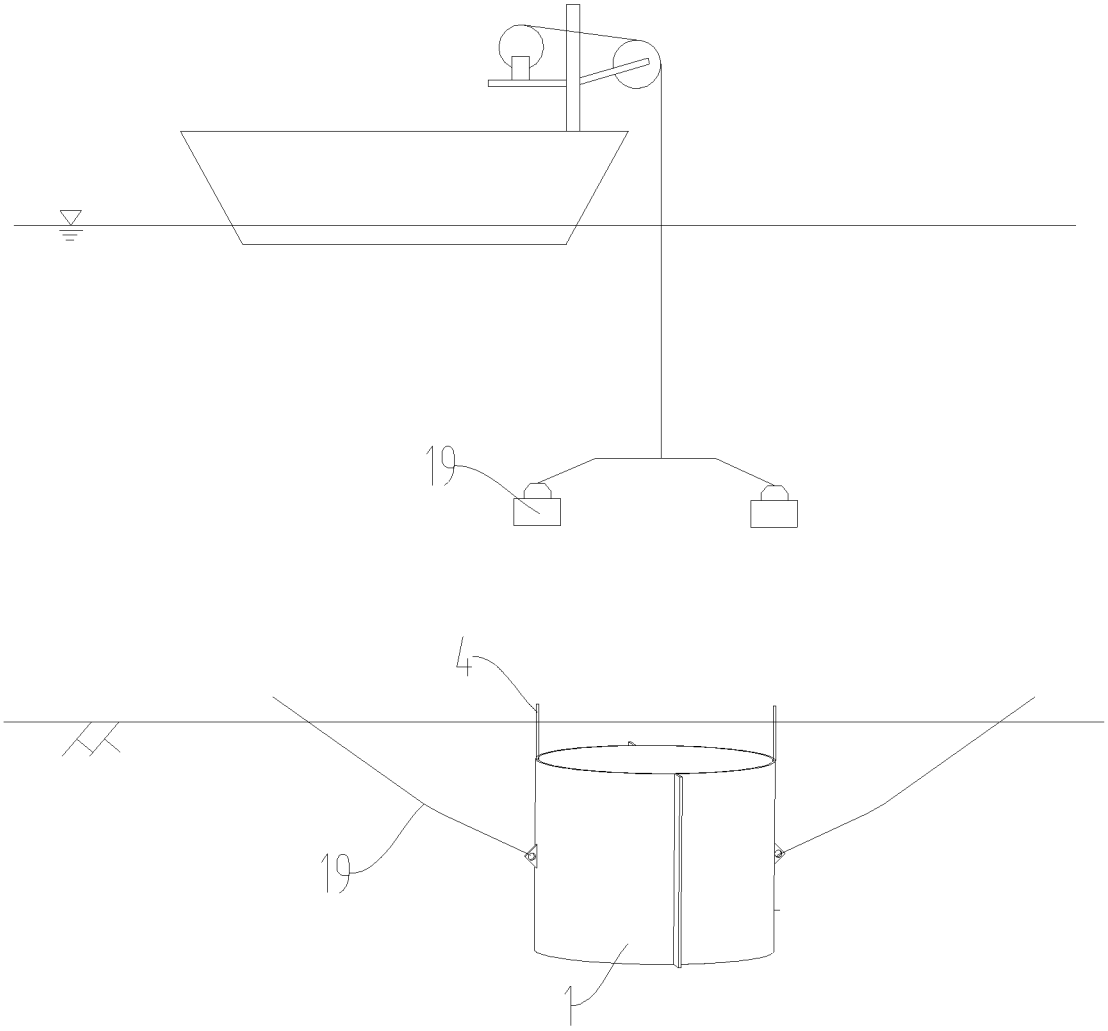
FIG. 14 is a structural schematic view of recycling the high-frequency vibratory hammer in FIG. 11.

As shown in FIGS. 8-10, the specific embodiment of the annular anchor installing method provided by this example is specifically applied to install the annular anchor described in Example 1 by using the annular anchor installing assembly described in Example 3, it includes the following steps.

Butting the open end of the installation tube 6 to the top of the annular anchor, connecting the anchor chain 5 on the annular anchor with the second installation lifting point 10 on the installation cover body 7, so that the annular anchor is fixed coaxially to the open end of the installation tube 6.

Connecting a hoist with the first installation lifting point 8 on the installation cover body 7, and hoisting the annular anchor and the installation tube 6 into the water by means of the hoist to sink them.

During the descent, actuating the installation pump body assembly 9 to drain the water in the installation tube 6 until the annular anchor is in contact with the seabed.

Removing the second installation lifting point 10 from the installation cover body 7 by means of an underwater robot, and hoisting the second installation lifting point 10 and the anchor chain 5 connected to it onto the surrounding seabed by means of a hoist.

Pumping water from the installation tube 6 by means of the installation pump body assembly 9, so that the annular anchor sinks down to the designed depth of the seabed under negative pressure.

Starting the installation pump body assembly 9 to fill water into the installation tube 6 for a pressure boost, meanwhile cooperating with a hoist to pull the installation tube 6 out of the seabed, leaving the annular anchor under the seabed.

Example 4

As shown in FIGS. 11-14, the specific embodiment of the annular anchor installing method provided by this example is specifically applied to install the annular anchor described in Example 1, it includes the following steps.

Installing the high-frequency vibratory hammer 19 on the top of the annular anchor, and connecting the anchor chain 5 on the annular anchor with the high-frequency vibratory hammer 19.

Connecting a hoist with the high-frequency vibratory hammer 19, and hoisting the annular anchor and the high-frequency vibratory hammer 19 into the water by means of the hoist to sink them onto the seabed.

Removing the anchor chain 5 from the high-frequency vibratory hammer 19 by means of an underwater robot, and dragging the free end of the anchor chain 5 onto the surrounding seabed.

Actuating the high-frequency vibratory hammer to laterally and longitudinally vibrate the annular anchor to sink the annular anchor to the designed depth below the seabed.

Removing the high-frequency vibratory hammer 19 from the annular anchor by means of an underwater robot, recycling the high-frequency vibratory hammer 19 by means of a hoist, and leaving the annular anchor under the seabed.

Specifically, the connection rod 4 is arranged between the annular anchor and the high-frequency vibratory hammer 19, and the height dimension of the connection rod 4 is greater than the designed depth of the annular anchor below the seabed. The arrangement of the connection rod 4 can adapt to the installation depth of the annular anchor, avoiding the high-frequency vibratory hammer 19 from difficultly sinking in the case of inadequate depth, and the decrease in efficiency.

Example 5

Figure 15:
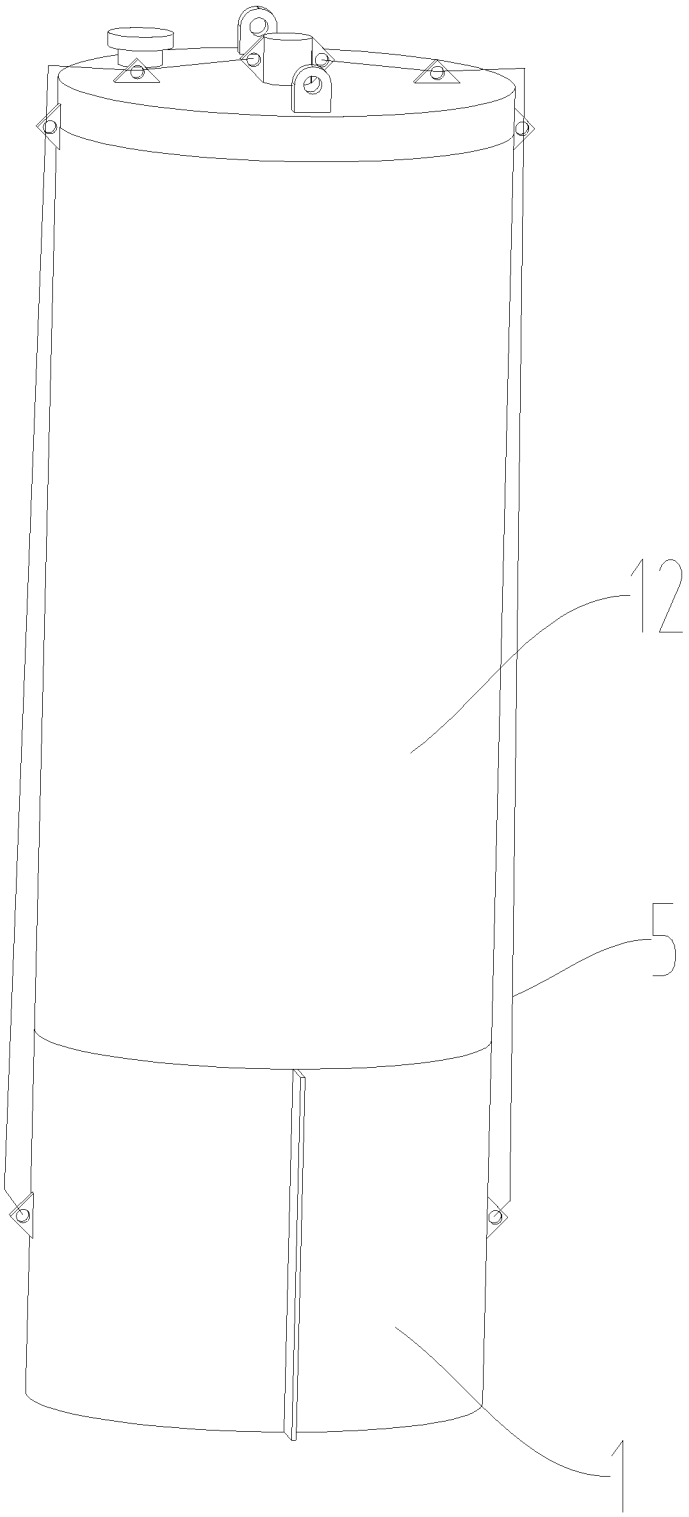
FIG. 15 is a structural schematic view of one specific embodiment of the annular anchor installing assembly provided in the fifth example of the present disclosure.
Figure 16:
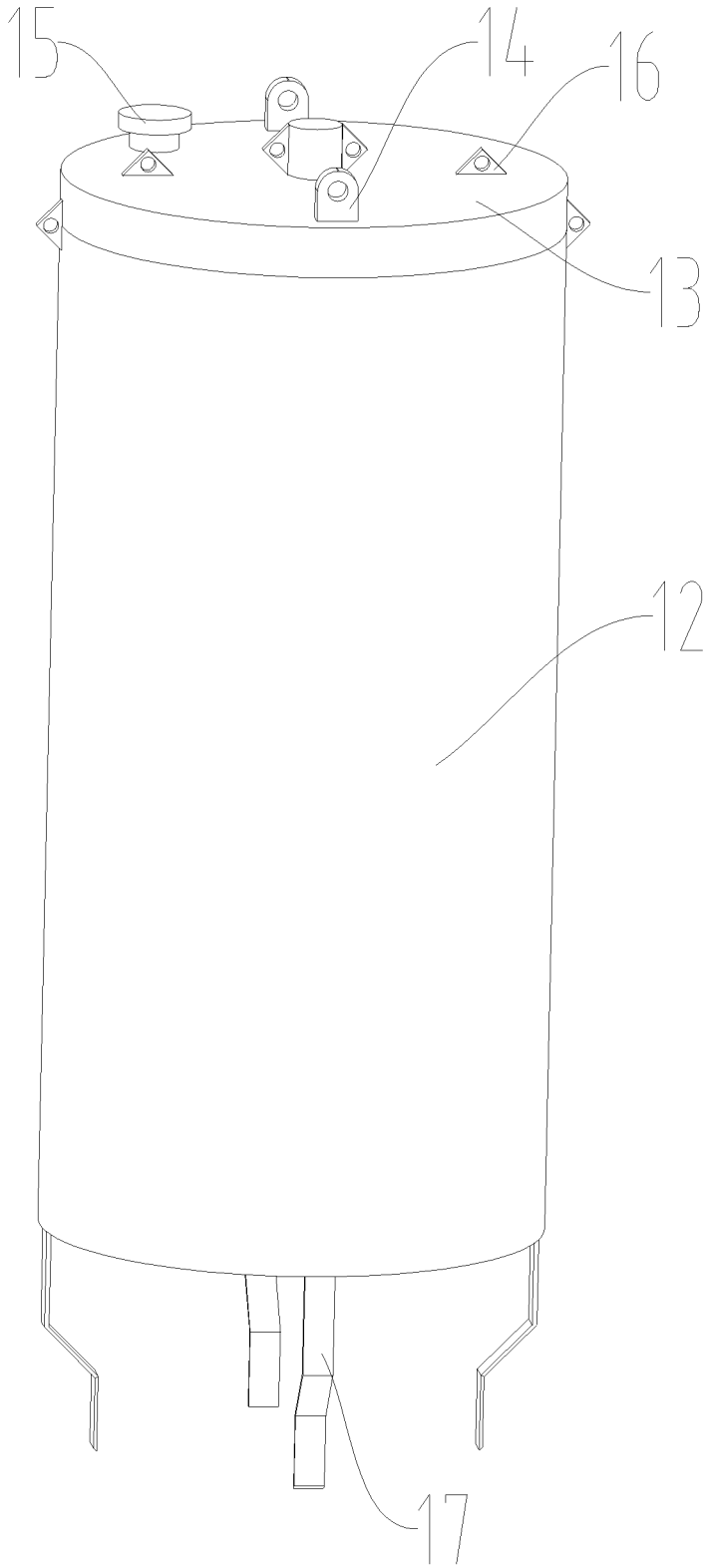
FIG. 16 is a structural schematic view of the recycling tube in FIG. 15.
Figure 17:
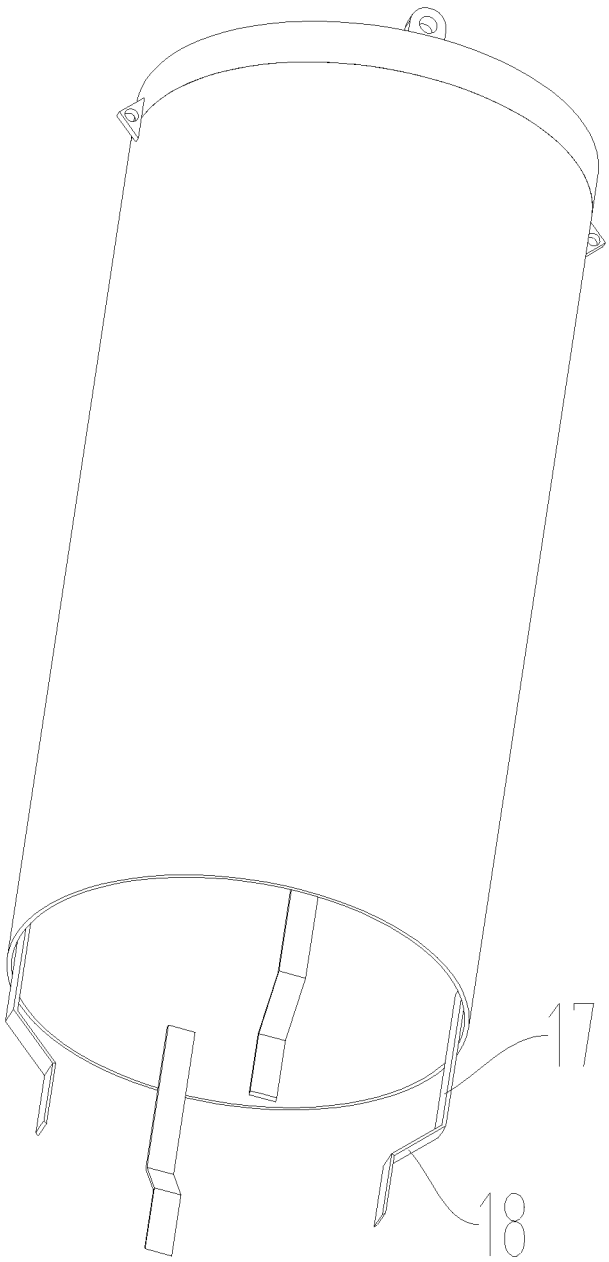
FIG. 17 is a structural schematic view of the bottom of the recycling tube in FIG. 16.

As shown in FIGS. 15-17, the specific embodiment of the annular anchor recycling assembly provided by this example includes the annular anchor as described in Example 1, and the recycling tube 12, one end of which is provided with the recycling cover body 13, and the other end of which is configured to be an open end used to cooperate with the top of the annular anchor; the first recycling lifting point 14 used to connect with a hoist, the recycling pump body assembly 15 used to perform a pressure boost in the interior of the recycling tube 12, and the second recycling lifting point 16 used to connect with the anchor chain 5 on the annular anchor are arranged on the recycling cover body 13. The recycling pump body assembly 15 during filling water enables the annular anchor and the recycling tube 12 to cooperate with a hoist, so as to hoist them to fast, simply, conveniently and less noisily complete recycling without a too big pulling force, and possibly reuse the recycling tube 12, reducing costs.

The height dimension of the recycling tube 12 is greater than the distance between the seabed and the top of the annular anchor during the latter's functioning, avoiding the recycling tube 12 from being jammed with too high soil in the process of negative pressure penetration, and the soil from being sucked into the recycling pump body assembly 15 to damage the equipment resultantly. Specifically, the first recycling lifting point 14 and the second recycling lifting point 16 are provided as a lifting lug structure, the annular anchor is coaxially fixed to the open end of the recycling tube 12 by the anchor chain 5, and the end face of the open end of the recycling tube 12 is butted to the end face of the annular anchor.

As shown in FIGS. 16-17, in the annular anchor recycling assembly provided by Example 5, the bottom end of the recycling tube 12 is provided with the recycling guiding piece 17 extending downwards from the inner wall and suitable for protruding into the interior of the annular anchor, and the bottom end of the recycling guiding piece 17 is provided with the guiding portion 18 bent toward its center. The recycling guiding piece 17 is configured to facilitate the rapid fit between the recycling tube 12 and the annular anchor and impose a radial restraint on the annular anchor, avoiding misalignment caused by instability between the annular anchor and the recycling tube 12 during installation, from affecting the recycling. The bottom end of the recycling guiding piece 17 is provided with the guiding portion 18 bent toward its center, which is configured to lock the annular anchor in advance, avoiding the annular anchor from tilting and resultant difficult butting junction.

Example 6

Figure 18:
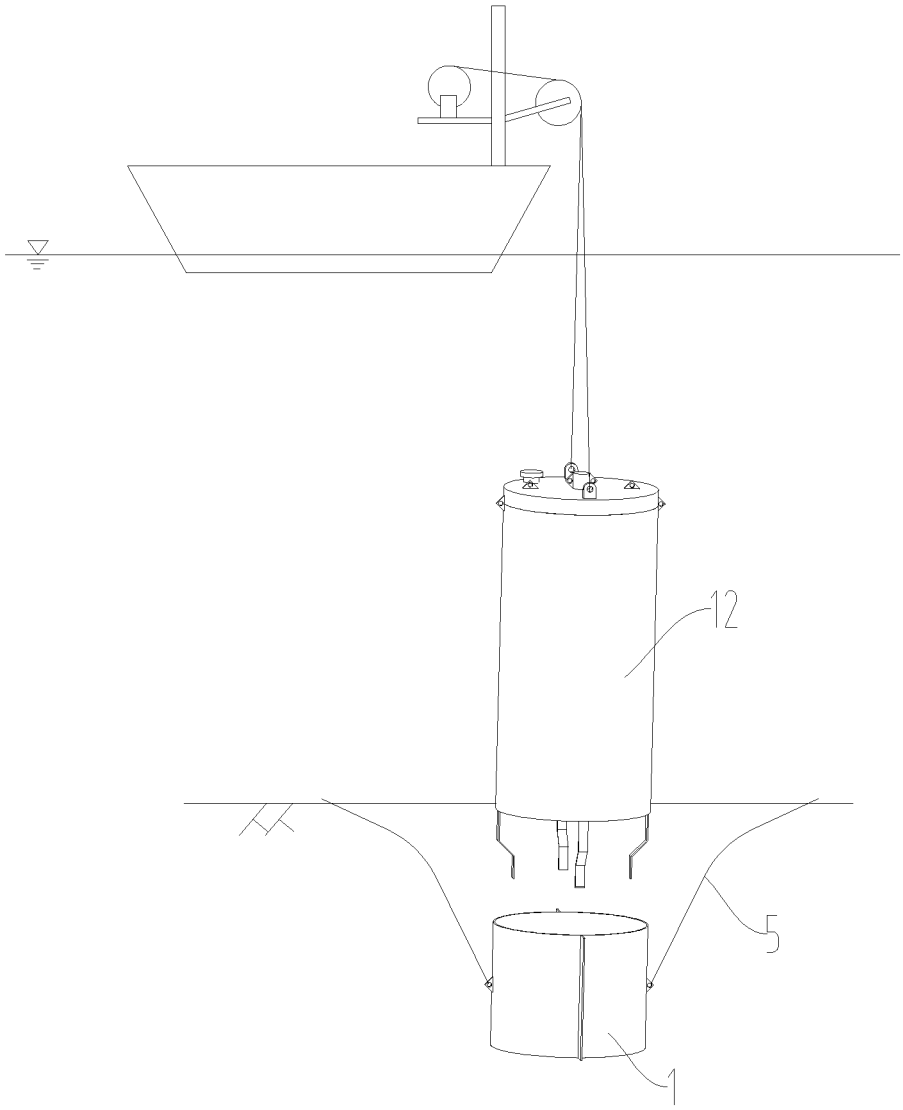
FIG. 18 is a structural schematic view of one specific embodiment of the annular anchor recycling method provided in the sixth example of the present disclosure.
Figure 19:
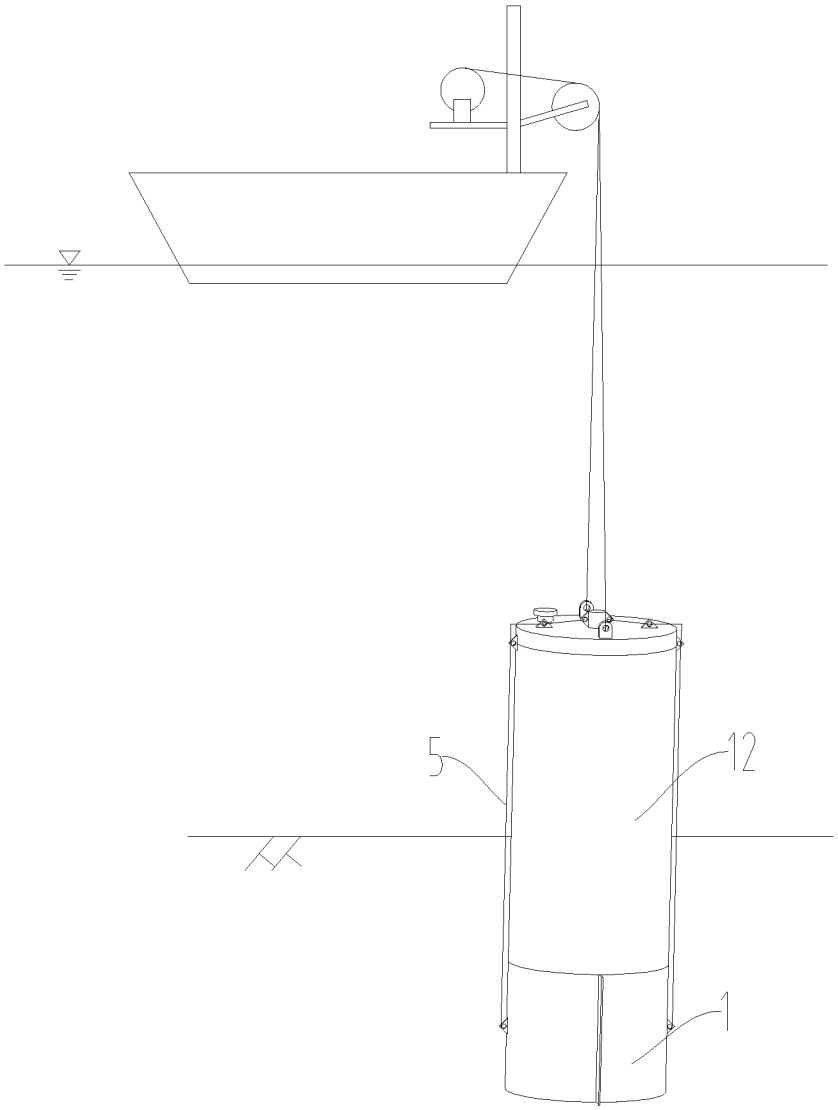
FIG. 19 is a structural schematic view of the recycling tube reaching the designed position in FIG. 18.
Figure 20:
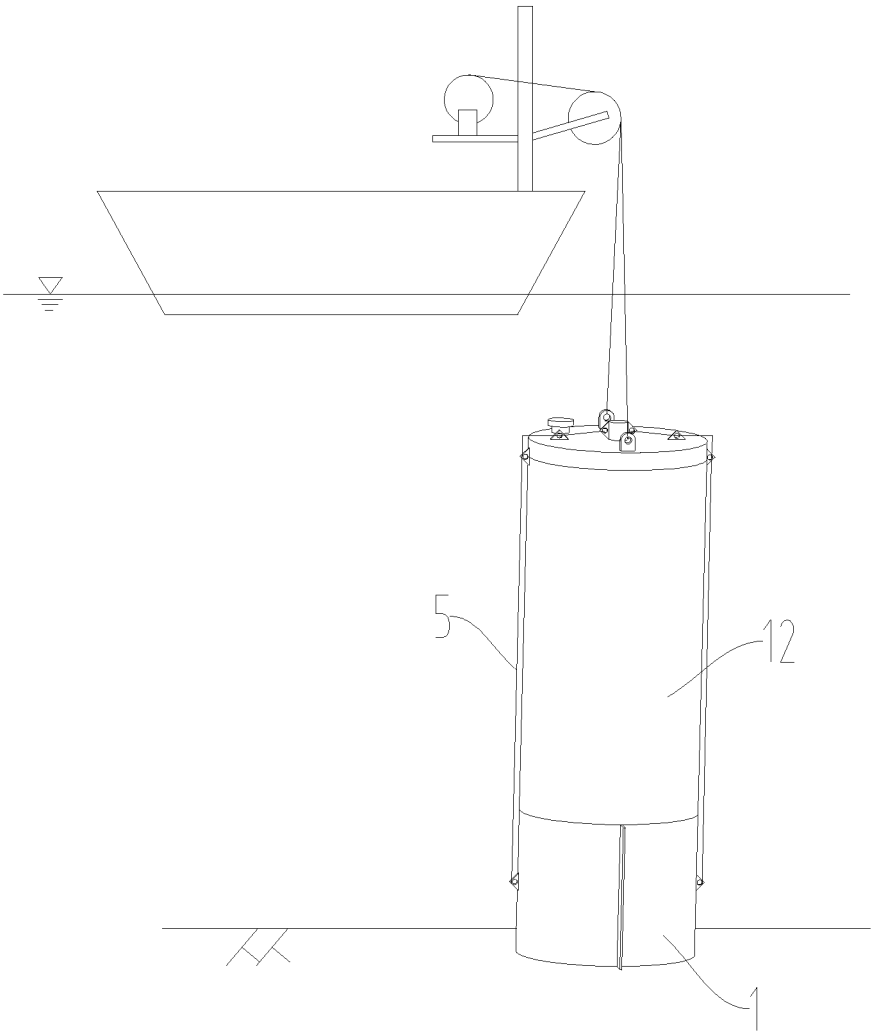
FIG. 20 is a structural schematic view of the annular anchor being recycled by a hoist in FIG. 19.

As shown in FIGS. 18-20, the specific embodiment of the annular anchor recycling method provided by this example is specifically applied to recycle the annular anchor described in Example 1 by using the annular anchor recycling assembly described in Example 6, it includes the following steps.

Connecting a hoist with the first recycling lifting point 14 on the recycling cover body 13, then hoisting the recycling tube 12 into the water to sink it.

During the descent, actuating the recycling pump body assembly 15 to drain the water in the recycling tube 12 to form a pressure difference between the inside and outside the recycling tube 12, sinking the recycling tube 12 above the annular anchor to be recycled under the action of the pressure difference, then butting the open end of the recycling tube 12 to the top of the annular anchor, wherein, the recycling tube 12 penetrates above the annular anchor at a speed of not more than 5 m/h.

Connecting the second recycling lifting point 16 on the recycling cover body 13 with the anchor chain 5 on the annular anchor by means of an underwater robot to fix the annular anchor coaxially to the open end of the recycling tube 12.

Starting the recycling pump body assembly 15 to fill water into the recycling tube 12 for a pressure boost, meanwhile cooperating with a hoist to pull the recycling tube 12 and the annular anchor out of the seabed.

The recycling tube 12 sinks to the upside of the annular anchor by a hoist, and the annular anchor is fixed to the open end of the recycling tube 12 by the anchor chain 5, then the recycling pump body assembly 15 starts to fill water into the recycling tube 12 for a pressure boost, and the hoist cooperating with it pulls the recycling tube 12 and the annular anchor out of the seabed, so as to recycle them fast and less noisily, and possibly reuse the recycling tube 12, reducing costs.

It is obvious that the above description only gives examples for clarity, which does not impose a limitation on their embodiments. A person skilled in the art can make various changes or modifications on the basis of the above description. There is no need and inability to give all exhaustive embodiments. However, the apparent changes or modifications derived therefrom still fall within the protection scope of the present disclosure.

What is claimed is:

1. A method for providing an annular anchor which comprises an anchor body (1) opened at its upper and lower ends, and a connection portion (2) arranged on an outer side wall of said anchor body (1) for connecting with parts to be moored, comprising the steps of:

calculating antitorque bearing strength of the annular anchor, wherein, calculating antitorque bearing strength of the anchor body (1) of the annular anchor based on the following calculation formula:

$$T_0 = \frac{\alpha s_u \pi D^2 L}{2}$$

where, $\alpha$ is a partial remodeling factor of soil strength, $\alpha=1$ for an undisturbed soil, and $\alpha=1/S_t$ for a completely-remolded soil, $S_t$ is sensitivity of soil;

$S_u$ is shearing strength of soil without drainage;

L is the height of the annular anchor,

D is the outer diameter of the annular anchor;

calculating the antitorque bearing strength of a single wing plate (3), based on the following formula:

$$\Delta T_{N=1} = \delta_{N=1} \int N_{p,N=1} s_u s \frac{s+D}{2} dz$$

where, s is the width of the wing plate, z is a depth of the annular anchor under a seabed; $\delta_{N=1}$ is a scale factor, which is calculated as follows;

$$\delta_{N=1} = 0.166 \log \frac{s}{D} + 1$$

$N_{p,N=1}$ is calculated as follows;

$$N_{p,N=1} = 2N_{p0,N=1}$$

$$N_{p0,N=1} = 11.94 - 8.72\left[1 - \left(\frac{L}{H(s+0.5)}\right)^{0.6}\right]^{1.35}$$

$$H = 16.8 - 2.3\log\left(\frac{s_{um}}{kD}\right)$$

where, $S_{um}$ is shearing strength of soil without drainage on the mud surface of the seabed;

k is a gradient of soil strength;

H is a gradient of normalized soil strength;

$N_{p,N=1}$ is a coefficient of horizontal bearing strength of the single wing plate when the plate and the soil are inseparable;

$N_{p0,N=1}$ is a coefficient of horizontal bearing strength of the single wing plate when the plate and the soil are separable;

calculating antitorque bearing strength of the annular anchor according to the antitorque bearing strength of the anchor body (1) of the annular anchor and the antitorque bearing strength of the single wing plate (3);

selecting an optimal size of the annular anchor according to the antitorque bearing strength of the annular anchor, and forming, according to the selected optimal size, the annular anchor that is used to be installed to the depth under the seabed.

2. The method for providing the annular anchor according to claim 1, wherein the method further includes a step of calculating the antitorque bearing strength of multiple single wing plates (3), based on the following formula:

$$\Delta T_N = \zeta_N \Delta T_{N=1}$$

where, $\Delta T_N$ is the antitorque bearing strength of all single wing plates; $\zeta_N$ is a wing plate's effect coefficient, its formula is as follows;

$$\zeta_N = \sum_{i=1}^{i=N} 0.5^{\left(\frac{i-1}{1.15}\right)^{2.3}}.$$

3. The method for providing the annular anchor according to claim 1, wherein the method further includes a step of calculating the antitorque bearing strength of an entire annular anchor, based on the following formula:

$$T_N = T_0 + \Delta T_N$$

where, $T_N$ is the antitorque bearing strength of the entire annular anchor.

4. The method for providing the annular anchor according to claim 1, wherein at least one group of wing plates (3) is arranged on the outer side wall of said anchor body (1), and the at least one group of wing plates (3) are spaced along the circumference of said anchor body (1).

* * * * *